United States Patent [19]

Tanaka et al.

[11] Patent Number: 4,525,447

[45] Date of Patent: Jun. 25, 1985

[54] IMAGE FORMING METHOD USING THREE COMPONENT DEVELOPER

[75] Inventors: Susumu Tanaka, Aichi; Kaoru Takebe, Toyokawa, both of Japan

[73] Assignee: Minolta Camera Kabushiki Kaisha, Osaka, Japan

[21] Appl. No.: 545,933

[22] Filed: Oct. 27, 1983

[30] Foreign Application Priority Data

Nov. 8, 1982 [JP] Japan ..... 57-196429
Jan. 26, 1983 [JP] Japan ..... 58-11789
Aug. 22, 1983 [JP] Japan ..... 58-153600

[51] Int. Cl.[3] ..... G03G 13/08; G03G 13/09

[52] U.S. Cl. ..... 430/122; 430/106.6; 430/120

[58] Field of Search ..... 430/106.6, 109, 120, 430/121, 122, 123

[56] References Cited

U.S. PATENT DOCUMENTS 3,013,890 12/1961 Bixby ..... 430/120 X
3,262,806 7/1966 Gourge ..... 430/122 X
3,650,797 3/1972 Tomanek ..... 430/109 X
4,142,981 3/1979 Bean et al. ..... 430/111 X
4,239,845 12/1980 Tanaka et al. ..... 430/122
4,301,228 11/1981 Kori et al. ..... 430/122
4,331,757 5/1982 Tanaka et al. ..... 430/122

*Primary Examiner*—Roland E. Martin
*Attorney, Agent, or Firm*—Wenderoth, Lind & Ponack

[57] ABSTRACT

An image forming method which includes following steps:

a. forming on a photosensitive member an electrostatic latent image having at least three different levels of potentials, i.e., having a first latent image and a second latent image;

b. developing the first and second latent images with a magnetic developer in the form of a mixture of at least three components, i.e., a magnetic carrier, a first toner triboelectrically chargeable to a specific polarity by contact with the magnetic carrier, and a second toner triboelectrically chargeable by contact with the first toner to a polarity opposite to the triboelectric charge polarity of the first toner but substantially not triboelectrically chargeable by contact with the magnetic carrier, by selectively depositing the first and second toners on the latent images; and c. transferring the resulting toner image onto the surface of a copy material.

6 Claims, 15 Drawing Figures

IMAGE FORMING METHOD USING THREE COMPONENT DEVELOPER

BACKGROUND OF THE INVENTION

1. Field of the Invention

The present invention relates to a method of forming monochromatic or dichromatic copy images by the use of a three-component developer.

2. Description of the Prior Art

To meet the need for diverse modes of processing information in recent years, copying machines have been developed for making copies of composite images by successively or simultaneously forming on the surface of an electrostatic latent image bearing member a first latent image and a second latent image having an opposite polarity to the first image, or having the same polarity as the first image but different therefrom in potential, developing the first and second latent images thus formed as a composite image to obtain a toner image, and transferring the toner image onto the surface of a copy material.

As one of the copying machines of the type described, Published Unexamined Japanese Patent Application No. SHO 57-8553, for example, discloses an electrophotographic copying machine wherein the surface of a uniformly charged electrophotographic photosensitive member is exposed to a positive image to form a first latent image and subsequently exposed to a negative image to form a second latent image, whereby a composite image is formed. With this copying machine, the first and second latent images are developed with toners of the same color or different colors.

Furthermore, various processes have also been proposed for forming dichromatic copy images from dichromatic originals. For example, published Unexamined Japanese Patent Application No. SHO 55-117155 discloses a process which employs a photosensitive member comprising a first photoconductive layer laminated to an electrically conductive substrate and photosensitive to a first color (e.g. red), an intermediate layer over the first layer, and a second photoconductive layer formed over the intermediate layer and photosesitive to a second color (e.g. black). Electrostatic latent images corresponding to copy images of a first color and a second color are formed in opposite relation in polarity by specified steps and then developed to visible images with two kinds of toners charged to a polarity oppositie to each other and having different colors.

Another process for forming dichromatic copy images has also been proposed which employs a photosensitive member comprising a photoconductive layer laminated to an electrically conductive substrate and having photosensitivity to both polarities as well as to two colors and in which electrostatic latent images corresponding to copy image areas of first color and second color are formed in opposite relation in polarity by specified steps and then developed with two kinds of toners of different colors.

However, because the composite image forming process and the dichromatic copy image forming processes described require at least two kinds of toners and especially because the latter processes require two toners of different colors, these processes have the drawback of generally necessitating two developing units, which inevitably render the copying machine large-sized. Although a dichromatic developing method has been proposed which uses a single developing unit, the method fails to give sharp dichromatic copies since fog or mingling of colors is liable to occur in copy images.

SUMMARY OF THE INVENTION

The main object of the present invention is to provide an image forming method capable of giving satisfactory monochromatic or dichromatic copy images by the use of a novel three-component developer.

Another object of the invention is to provide an image forming method capable of giving satisfactory, monochromatic or dichromatic copy images free from fog by the use of a novel three-component developer and a single developing unit.

Another object of the invention is to provide an image forming method capable of giving satisfactory dichromatic copy images free of fog or mingling of colors without necessitating a copying machine of increased size.

Still another object of the invention is to provide an image forming method capable of giving fog-free, sharp composite images and dichromatic copy images by the use of a novel three-component developer which assures easy condition setting and use of a machine of simple construction.

These and other objects of the present invention can be fulfilled by an image forming method characterized by forming through specified steps a first electrostatic latent image and a second electrostatic latent image which is different from the first latent image in potential and which has the same polarity as or an opposite polarity to the first latent image, and developing the electrostatic latent images with a magnetic developer in the form of a mixture of at least three components, i.e., a magnetic carrier, a first toner triboelectrically chargeable to a specified polarity by contact with the magnetic carrier, and a second toner triboelectrically chargeable by contact with the first toner to a polarity opposite to the triboelectric charge polarity of the first toner but substantially no triboelectrically chargeable by contact with the magnetic carrier.

DETAILED DESCRIPTION OF THE INVENTION

Figure 1:
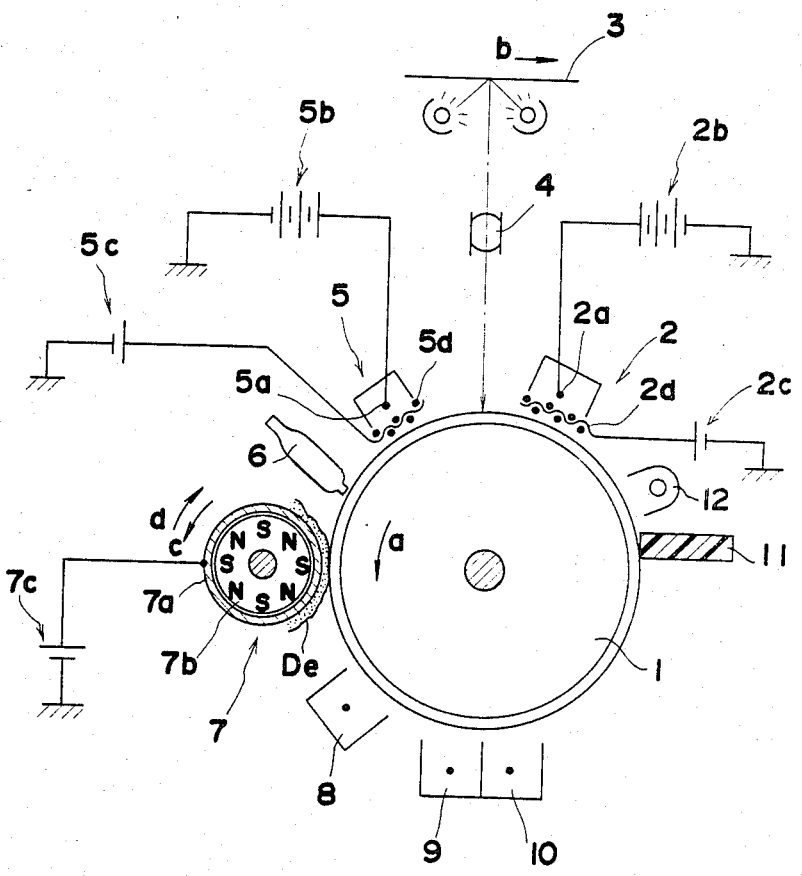
FIG. 1 is a diagram in section schematically showing the construction of a copying machine for forming composite images by the method of the invention.

FIG. 1 shows a first embodiment of copying machine which is adapted to practice the image forming method of the invention and which is suitable for producing composite images. An electrophotographic photosensitive drum 1 drivingly rotatable in the direction of arrow a shown is first uniformly charged to a specified polarity by a first scorotron charger 2. This step is shown in FIG. *2a;* the drum 1 is charged to a surface potential of V1. The first scorotron charger 2 comprises a corona electrode *2a* connected to a d.c. high voltage source *2b* and a grid electrode *2d* connected to a d.c. bias voltage source *2c* and disposed between the corona electrode *2a* and the drum 1. The surface of the drum 1 is uniformly charged to a potential approximately equal to the potential applied to the grid electrode *2d*. The charger for uniformly charging the surface of the drum 1 is not limited to the scorotron type the charger 2 but may be a corotron type.

Subsequently the drum 1 is continuously exposed by an optical system 4 to the positive image of a positive original 3, whereby the potential of the nonimage area is attenuated to VL, while the potential of the image area remains about V1 as shown in FIG. *2b*. Thus, a first electrostatic latent image is formed. During the exposure, the positive original 3 is moved in the direction of arrow b in synchronism with the drum 1.

Like the charger 2, a second scorotron charger 5 comprises a corona electrode *5a* connected to a d.c. high voltage source *5b* and a grid electrode *5d* connected to a d.c. bias voltage source *5c* and interposed between the corona electrode *5a* and the drum 1, whereby the potential of the nonimage area of the first latent image formed as above is made approximately equal to the bias potential applied to the grid electrode *5d*. The bias voltage source *5c* may be replaced by a constant voltage diode, discharge tube, ZnR or like constant voltage driven element. While the second scorotron charger 5 functions to increase the potential VL to a stable uniform intermediate potential V2 (see FIG. *2c*), the charging by the charger 5 can be omitted if the exposure of the drum to the positive original 3 is so adjusted that the surface potential of the drum is attenuated to a relatively stable level of about one half of V1 at the nonimage area.

The surface of the drum 1 having the first latent image formed thereon as described above is continuously exposed to a negative image by a light-emitting diode 6 to form a second latent image. More specifically, the drum surface is exposed to a negative image corresponding to electric signals delivered from an unillustrated image treating unit. The light-emitting diode 6 for forming the second latent image can be replaced by a laser scanner, OFT, liquid crystal array or the like as desired. The exposure to the negative image produces an image area of attenuated potential of V3 as shown in FIG. *2d*.

A magnetic brush developing roller 7 for developing the first and second latent images by a magnetic brush by the use of a magnetic developer De comprises a developing sleeve *7a* drivingly rotatable at a low speed in the direction of arrow c and a magnetic roller *7b* drivingly rotatable at a high speed in the direction of arrow d for transporting the developer De in the direction of arrow c. The developing sleeve *7a* is connected to a d.c. bias voltage source *7c*. In accordance with a bias voltage Vb applied to the sleeve *7a*, two different kinds of toners contained in the developer De are selectively deposited on the first and second latent images. As will be described later, the developer De is a mixture of a magnetic carrier, and two different kinds of toners which are triboelectrically chargeable to a polarity opposite to each other. These toners are deposited on the respective latent image areas when the bias voltage Vb is set to a level approximately equal to or slightly higher than the intermediate potential V2 as shown in FIG. *2e*.

Prior to transfer, the toners deposited on the surface of the drum 1 are made to have the same polarity by a precharging corona charger 8. The toner image obtained by development is transferred to the surface of copy paper by a transfer corona charger 9. The charger 9 has attached thereto a separating corona charger 10 by which the copy paper bearing the transferred toner image on its surface is separated from the surface of the drum 1. The developer remaining on the surface of the drum 1 is removed therefrom by a cleaning blade 11, while the charges remaining on the drum surface are removed by an eraser lamp 12.

Figure 3:
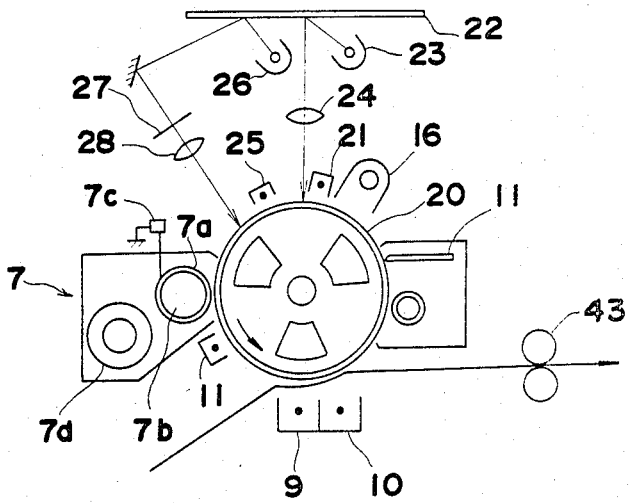
FIG. 3 is a diagram showing another embodiment of a copying machine for forming dichromatic copy images from dichromatic originals by the method of the invention.

FIG. 3 shows a copying machine for forming a dichromatic image from a dichromatic original by the method of the present invention. The same parts as those shown in FIG. 1 will be referred to by the same corresponding numerals individually and will not be described.

With reference to FIG. 3, a photosensitive drum 20 which is sensitive to both positive and negative polarities and rotatable counterclockwise is first uniformly charged to a first polarity by a first corona charger 21. Subsequently a dichromatic original placed on a reciprocatingly movable carriage 22 is illuminated with an exposure lamp 23, and the image of the original is continuously projected onto the drum 20 through a lens 24, whereby a primary electrostatic latent image is formed. This latent image is then charged by a second corona charger 25 of second polarity. The same original is thereafter exposed to light by an exposure lamp 26, and the image of the original is projected on the drum through a cutoff filter 27 and a lens 28 to form a secondary electrostatic latent image. The magnetic brush developing unit 7 shown, although having the same construction as the one shown in FIG. 1, is additionally provided with a roller *7d* for agitating the developer.

With the copying machine of the foregoing construction, the drum 20 during rotation is first uniformly charged by the first corona charger 21 to a surface potential Vo of positive polarity as shown in FIG. *4a*. Next, the drum 20 is exposed to the optical image of a dichromatic original to form a primary electrostatic latent image thereon as seen in FIG. *4b*. When the original includes a red image and a black image, the exposure attenuates the potential Vo to Vr at the portion corresponding to the red image area and to Vg approximate to 0 at the nonimage area (blank area), but the potential remains almost Vo at the black image area. The primary latent image having the potential pattern of Vo, Vr and Vg is charged by the second corona charger 25 to negative polarity to form the pattern of FIG. *4c*. Thus the lowest nonimage area potential Vg is inverted to Vg' of negative polarity and the red image area potential Vr also to V1 of negative polarity by the negative charging, with the black image area potential Vo lowered to V2 and retaining the positive polarity. In this state, the drum 20 is exposed again to the optical image of the same original, through the red cutoff filter 27 at this time to thereby form a secondary electrostatic latent image of the potential pattern shown in FIG. *4d*. This exposure attenuates the nonimage area potential Vg' to V3 approximate to 0, while permitting the red and black image area potentials V1 and V2 to remain unchanged.

The secondary latent image thus formed is then developed by the magnetic brush developing unit 7 by the use of the three-component developer to be described later. For the development, the bias voltage Vb is set to a level approximately equal to or slightly higher or lower than the nonimage area potential V3.

Figure 5:
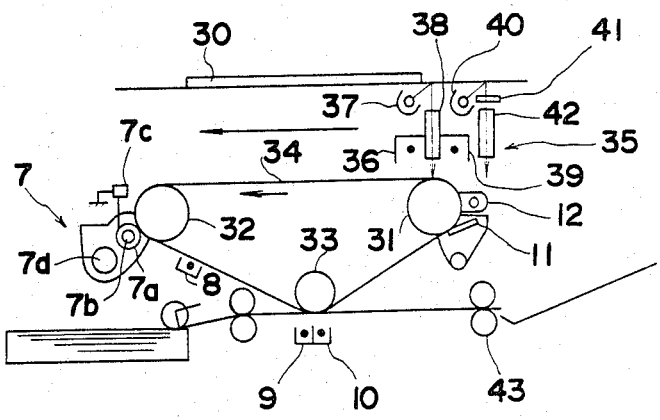
FIG. 5 is a diagram showing another embodiment of a copying machine for forming dichromatic images.

FIG. 5 shows another embodiment of a copying machine which is also adapted to form a dichromatic toner image from a dichromatic original. The same parts as those shown in FIG. 3 will be referred to by the same corresponding numerals individually and will not be described. Indicated at 30 is a fixed carriage for supporting a dichromatic original thereon. A photosensitive belt 34 disposed below the carriage 30 is rotatably supported by rollers 31, 32 and 33 including a drive roller. A unit of optical system 35 reciprocatingly movable in its entirety is provided between the belt 34 and the carriage 30. The unit 35 comprises a first corona charger 36 for uniformly charging the surface of the belt 34 to a first polarity, a first image transmitter 38 formed by a bundle of optical fibers having graded refractive indexes, such as SELFOC, for continuously projecting the image of the original illuminated by a first exposure lamp 37, a second corona charger 39 for charging the belt surface to a second polarity, and a second image transmitter 42, such as the one mentioned above, for projecting the image of the original illuminated by a second exposure lamp 40 and received through a cutoff filter 41.

Figure 4A:
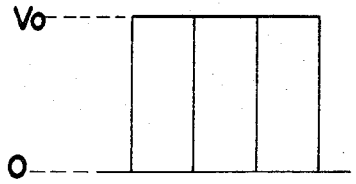
FIGS. 4*a* to 4*e* are diagrams showing the steps of forming a dichromatic copy image by the copying machine of FIG. 3.
Figure 4B:
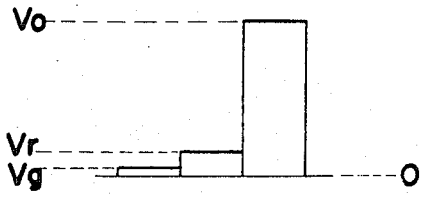
Figure 4C:
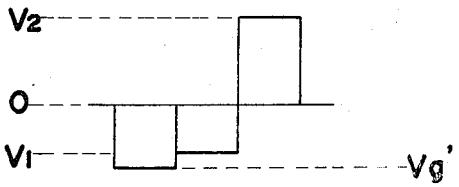
Figure 4D:
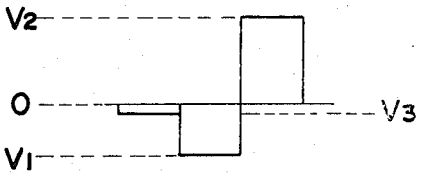

For a copying operation, the optical unit 35 is moved forward in the direction of the arrow shown, with the belt 34 at rest, whereby the belt surface is first uniformly charged by the first corona charger 36, for example, to positive polarity as shown in FIG. 4*a*. This uniform charging is followed by continuous exposure of the belt surface to the image of the dichromatic original by means of the first exposure lamp 37 and the first image transmitter 38, whereby a primary electrostatic latent image is formed as shown in FIG. 4*b*. While being continuously formed, the priamry latent image is charged by the second corona charger 39 of negative polarity to form a potential pattern as shown in FIG. 4*c*. The image of the same original is further projected on the belt surface by means of the second exposure lamp 40, the cutoff filter 41 and the second image transmitter 42. Thus a secondary electrostatic latent image as shown in FIG. 4*d* is eventually formed on the planar portion of the belt 34 opposed to the carriage 30.

Upon the formation of the secondary latent image, the photosensitive belt 34 starts to travel, causing magnetic brush developing unit 7 to develop the image in two colors as shown in FIG. 4 with the application of bias voltage Vb. This step will be described later. The developed image is then charged by a precharging corona charger 8, thereafter transferred to copy paper and fixed by a heat roller 43.

Figure 6:
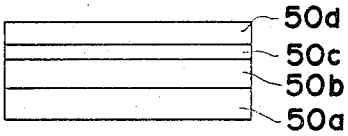
FIG. 6 is a diagram showing a photosensitive member which is usable for the invention.

With the copying machines described above and shown in FIGS. 3 and 5, the photosensitive members used are photosensitive to both polarities and form the latent image to be eventually developed by being exposed to the original image twice, while the photosensitive member disclosed in the above-mentioned publication, i.e., Published Unexamined Japanese Patent Application No. SHO 55-117155, is adapted to form a dichromatic copy image by a single exposure to the original image without necessitating any cutoff filter. This photosensitive member is shown in FIG. 6 and comprises a first photoconductive layer 50*b*, an intermediate layer 50*c* and a second photoconductive layer 50*d* which are laminated in succession to an electrically conductive substrate 50*a*. The first photoconductive layer 50*b* is chargeable to a first polarity and has sensitivity, for example, to light rays other than red, while the second photoconductive layer 50*d* is chargeable to a second polarity and is sensitive to red light.

Figure 7:
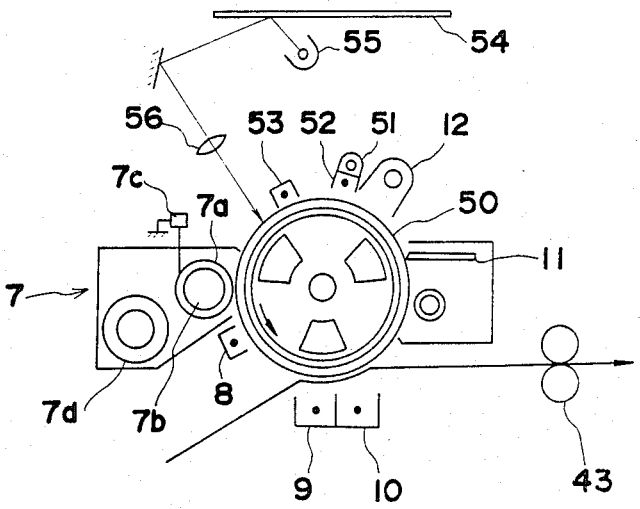
FIG. 7 is a diagram schematically showing the construction of a copying machine incorporating the photosensitive member of FIG. 6.

FIG. 7 schematically shows the construction of a copying machine wherein the above-described photosensitive member 50 is used for producing dichromatic copy images. The member 50 is first irradiated with red light and subjected to primary charging of positive polarity by a unit comprising a lamp 51 and a first corona charger 52, whereby the second photoconductive layer 50*d* is made conductive, a distribution of positive charges is induced at the interface between the second layer 50*d* and the intermediate layer 50*c*, and a distribution of negative charges is induced at the interface between the substrate 50*a* and the first photoconductive layer 50*b*. The member 50 is then subjected by a second corona charger 53 to secondary charging of negative polarity to a potential lower than the primary charging to invert the surface potential of the second photoconductive layer 50*d* to negative polarity, whereby an electric double layer is formed in the first and second photoconductive layers 50*b* and 50*d*. Subsequently a dichromatic original on a reciprocatingly movable carriage 54 is illuminated by an exposure lamp 55 to continuously project the original image on the member 50 through a lens 56. The exposure attenuates the potential of the photosensitive portion to 0 at the blank portion, while at the red portion, the second photoconductive layer 50*d* only is made conductive with disappearance of the electric double layer, and the surface potential is inverted to positive polarity. Meanwhile, the potential of the black portion retains negative polarity. The electrostatic latent image thus formed is next developed in two colors by a magnetic brush developing unit 7 in the same manner as will be described later in detail. The process for forming an electrostatic latent image corresponding to a dichromatic original, as well as the photosensitive member, is not limited to the foregoing; the processes disclosed for example, in Published Unexamined Japanese Patent Application No. SHO 54-112634, U.S. Pat. No. 4,335,194, etc. are usable. In brief, any process is useful insofar as the latent image can be so formed that the potentials corresponding to the first color and the second color are in opposite relation in polarity.

To sum up, the image forming process of the present invention to be executed by the copying machines of FIGS. 1, 3, 5 and 7 includes the following steps.

a. The step of forming on the photosensitive member an electrostatic latent image having at least three different levels of potentials. With the copying machine of FIG. 1, this step forms a composite latent image composed of a first electrostatic latent image and a second electrostatic latent image of the same polarity as the first but different in potential. With the copying machines of FIGS. 3, 5 and 7, this step forms a dichromatic latent image corresponding to a dichromatic original and composed of a first electrostatic latent image having an image area of a first color and a second electrostatic latent image having an image area of a second color and opposite to the first in polarity.

b. The step of developing the first and second latent images with a magnetic developer in the form of a mixture of at least three components, i.e., a magnetic carrier, a first toner triboelectrically chargeable to a specific polarity by contact with the magnetic carrier, and a second toner triboelectrically chargeable by contact with the first toner to a polarity opposite to the triboelectric charge polarity of the first toner but substantially not triboelectrically chargeable by contact with the magnetic carrier, by depositing the first and second toners on the latent images selectively.

c. The step of transferring the resulting toner image onto the surface of a copy material.

By the process described above, the first and second latent images can be developed in different colors, or in some case, in the same color, without using a copying machine which is inevitably made large-sized by being adapted to produce composite copy images or dichromatic copy images. The copy images obtained by the present process are free from fog, and the process does not cause fuming of the developer within the copying machine.

The property of the second toner that it is substantially not triboelectrically chargeable by contact with the magnetic carrier can be defined in terms of the absolute value of the amount of charges on the second toner which is up to 2.0 $\mu c/g$, preferably up to 1.5 $\mu c/g$, as determined by a method of measuring the amount of film development charges, i.e., by developing the surface of an insulating film charged to a polarity opposite to the polarity of charges on the second toner (triboelectrified by the magnetic carrier) with a thoroughly agitated mixture of the second toner and the magnetic carrier and determining the amount of charges on the toner from the resulting reduction of the surface potential on the film and the amount of toner deposited on the film surface. If the amount of charges on the toner is very small, no toner will be deposited on the surface of the insulating film which will make it impossible to measure the amount of charges on the toner. However, the deposition of no toner indicates that the toner is not charged.

The following two kinds of developers are useful for the present invention as the magnetic developer comprising the three components, namely the magnetic carrier, the first toner and the second toner.

The first kind of developer comprises the components described below. The magnetic carrier has a high resistivity of at least $10^{12}$ $\Omega$·cm and can be prepared, for example, by mixing together a resin and a fine magnetic powder in a molten state to obtain a dispersion containing 50 to 75 wt. % of the magnetic powder, pulverizing the dispersion after cooling and separating a fraction having a mean particle size of 25 to 50 $\mu$m. Examples of useful resins are polyethylene, polyacrylic ester, polymethyl methacrylate, polystyrene, styrene-acrylic copolymer, epoxy resin, cumarone resin, maleic acid resin, phenolic resin, etc. Examples of useful fine magnetic powders are $Fe_2O_3$, $Fe_3O_4$, ferrite and like powders which have 0.1 to 5 $\mu$m mean particle size.

Preferably the first toner is an insulating nonmagnetic toner having a mean particle size of 5 to 20 $\mu$m. When required, however, the toner can be magnetic. As the first toner, a suitable known toner is usable which has insulating properties of at least $10^{14}$ $\Omega$·cm in terms of resistivity.

It is desired that the second toner be a magnetic toner having a high resistivity of at least $10^{12}$ $\Omega$·cm and a mean particle size of 5 to 20 $\mu$m. It is critical that the second toner be substantially not triboelectrically chargeable by contact with the magnetic carrier. To assure this with ease, it is possible, for example, to prepare this toner from the same composition as the magnetic carrier. To prevent deposition of the magnetic carrier on the second latent image and thereby preclude waste of the carrier when the magnetic carrier has a high resistivity, it is required that the particle size of the second toner be smaller than that of the magnetic carrier in particle size and/or that the second toner have a degree of magnetization lower than the magnetic carrier. Such a magnetization degree can be given to the second toner most usually by incorporating the fine magnetic powder therein in a lower proportion than in the magnetic carrier. Further in order to effect electrostatic deposition of the second toner on the first latent image, it is required that the second toner be triboelectrically chargeable by the first toner to a polarity opposite to the polarity of the first latent image.

The second kind of developer is composed of the following components. The magnetic carrier is a highly magnetic material which has at least $10^7$ $\Omega$·cm resistivity and 25 to 90 $\mu$m mean particle size. In other words, the carrier can be made of a single highly magnetic particulate material. When desired, the surface of the highly magnetic particles may be covered with a thin coating of resin or like insulating material.

It is required that the first and second toners have a resistivity of at least $10^{12}$ $\Omega$·cm and a mean particle size of 5 to 20 $\mu$m and that at least one of the toners be magnetic. The magnetic toner can be prepared, for example, by mixing together a resin and a fine magnetic powder in a molten state to obtain a dispersion containing 10 to 70 wt. % of the magnetic powder, pulverizing the dispersion after cooling and separating a fraction of desired particle size. Examples of useful resins are polyethylene, polyacrylic ester, polymethyl methacrylate, polystyrene, styrene-acrylic copolymer, epoxy resin, cumarone resin, maleic acid resin, phenolic resin, etc. Examples of useful fine magnetic powders are $Fe_2O_3$, $Fe_3O_4$, ferrite and like powders which have 0.1 to 5 $\mu$m mean particle size. However, it is critical that the second toner be substantially not triboelectrically chargeable by contact with the highly magnetic carrier. To assure this, it is desired in determining the composition of the toner to give consideration to the position of the highly magnetic carrier in the triboelectric series.

Figure 2A:
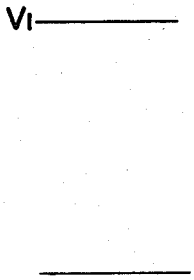
FIGS. 2*a* to 2*e* are diagrams showing the steps of forming a composite image by the copying machine of FIG. 1.
Figure 2B:
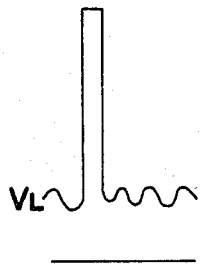
Figure 2C:
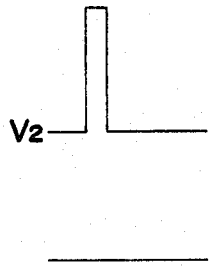
Figure 2D:
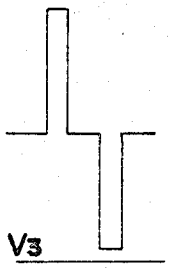
Figure 2E:
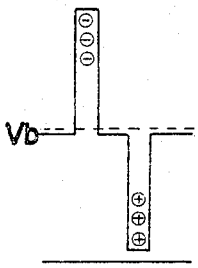

Before development, the developer of whichever kind is thoroughly agitated. The first toner is triboelectrically charged to a first polarity by contact with the magnetic carrier (which is therefore triboelectrically charged to a second polarity). The second toner, although substantially not triboelectrically charged by the carrier, is triboelectrically charged to the second polarity by contact with the first toner. With the copying machine of FIG. 1, the first and second latent images formed by the steps of FIGS. 2*a* to 2*d* are developed by the magnetic brush developing unit 7 wherein during development the d.c. bias voltage source 7*c* applies to the developing sleeve 7*a* a bias voltage Vb which is approximately equal to or slightly lower than the intermediate potential V2. More specifically stated assuming that the latent images have positive polarity for example, the second toner of negative polarity is deposited on the first latent image by normal development, and the first toner, which is opposite to the second toner in polarity, is deposited on the second latent image by reversal development. Stated with reference to FIG. 2*e*, the second toner is deposited between Vb and V1, while the first toner is deposited between V2 and V3. If the first and second toners are different in color, the copy obtained assures convenience in edition and discrimination. The mechanism of development will be described in detail in the experimental examples to follow. The composite image thus developed is then charged by the precharging corona charger 8, for example, to negative polarity to cause the first and second toners to have the same polarity, and the image is thereafter transferred to copy paper by the transfer corona charger 9. The toners remaining on the drum 1 are removed by the cleaning blade 11, while the residual charges are eliminated by the eraser lamp 12 to make the drum 1 ready for the next copying cycle.

Figure 4E:
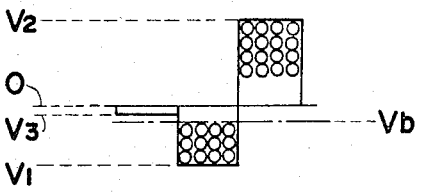

In the case of the copying machines of FIGS. 3 and 5, the first and second toners are different in color. For developing the electrostatic latent images formed as shown in FIG. 4*d*, the second toner (black) triboelectrically charged to negative polarity is deposited by normal development on the first latent image represented by V2, with the application of a bias voltage Vb which is slightly higher than the nonimage area potential V3, and the first toner of positive polarity is deposited similarly by normal development on the second latent image represented by V1, as shown in FIG. 4*e*. Latent images corresponding to the respective color image areas and in opposite relation to each other in polarity are similarly developed by the copying machine of FIG. 7.

The image forming method of the present invention will be described more specifically with reference to the following experimental examples which are typical of the numerous experiments carried out by the present inventors.

EXPERIMENTAL EXAMPLE 1

The copying machine shown in FIG. 1 was used. The surface of the photosensitive drum 1 was positively charged to 600 V uniformly by the charger 2 and then exposed to a positive image through the optical system 4 to form a first latent image having an image area potential V1 of 600 V. Subsequently the nonimage area of the drum 1 was charged to an elevated intermediate potential V2 of 350 V by the charger 5 and exposed to a negative image by the light-emitting diode 6 to form a second latent image having an image area potential V3 of 100 V.

The first and second latent images thus formed were then developed with the above-defined first kind of developer (hereinafter referred to as "developer I") by the developing roller 7 to obtain a toner image, which was transferred to copy paper to obtain a copy image. For the development, the d.c. bias voltage source 7*c* was set to a voltage value Vb of 300 V to apply a developing bias of 300 V to the developing sleeve 7*a*. Thus the developing bias was set to a slightly lower level than the nonimage area intermediate potential V2 of 350 V on the drum 1, slightly closer to the potential of the second latent image.

The developer I was a mixture of 67 wt. % of magnetic carrier having a mean particle size of 35 μm and a resistivity of $10^{13}$ Ω·cm and prepared from the following ingredients:

| | |
|---|---|
| styrene-acrylic copolymer ("HYMER-SBM73," product of Sanyo Kasei Co., Ltd.) | 100 parts by weight |
| fine magnetic powder ("MAGNETITE RB-BL," product of Chitan Kogyo Co., Ltd.) | 200 parts by weight |
| carbon black ("MA#100," product of Mitsubishi Kasei Co., Ltd.) | 4 parts by weight |

by mixing the ingredients together in a molten state, pulverizing the mixture after cooling and screening the resulting particles for classification, 13 wt. % of nonmagnetic toner (first toner, which will be feferred to as "toner A") having a mean particle size of 12 μm and a resistivity of $10^{15}$ Ω·cm and similarly prepared from:

| | |
|---|---|
| styrene-acrylic copolymer ("PLIOLITE AC," product of The Goodyear Tire & Rubber Co.) | 100 parts by weight |
| carbon black ("MA#100") | 8 parts by weight |
| charge control dye ("NYGROSINE," product of Orient Kagaku Co., Ltd.) | 2 parts by weight |

and 20 wt. % of magnetic toner (second toner, which will be referred to as "toner B") having a mean particle size of 11 μm and a resistivity of $10^{14}$ Ω·cm and similarly prepared from:

| | |
|---|---|
| styrene-acrylic copolymer ("HYMER-SBM73") | 150 parts by weight |
| fine magnetic powder ("MAGNETITE RB-BL") | 100 parts by weight |
| carbon black ("MA#100") | 6 parts by weight |

The toners A and B were both black. The amounts of charges on the toners A and B triboelectrified by the magnetic carrier were +15 μc/g and −0.8 μc/g, respectively (as determined by the aforesaid method of measuring the amount of film development charges).

The copy image obtained was satisfactory in image density and quality free from fog, indicating that the first and second latent images were reproduced into a composite visible image with high fidelity. During the experiment, the developer gave off little or no fumes in the vicinity of developing roller 7, while no fuming was observed in the other interior portions of the copying machine.

A detailed description will be given of the phenomena produced during the development of electrostatic images in the present experiment. First, when the first latent image is developed, the magnetic carrier and the toner B in the developer I, which are triboelectrically charged to negative polarity by contact with the toner A, both tend to be deposited on the image area of the first latent image having the potential V1 of 600 V. However, since the magnetic carrier has a particle size larger than the toner B and is highly magnetically attracted toward the magnetic roller 7*b* because of its higher degree of magnetization, the magnetic carrier actually is not deposited on the image area, permitting the toner B alone to be deposited on the image area. Incidentally, it is noted that the nonimage area potential V2 of 350 V is closer to the potential of the first latent image than the developing bias voltage Vb of 300 V, so that an electrostatic force acts to deposit the toner B onto the nonimage area. Nevertheless, the toner B, which is magnetic, is subjected to a magnetic force acting in an opposite direction to the electrostatic force and greater than the electrostatic force, with the result that no deposition of the toner B occurs on the nonimage area. Next, when the second latent image is developed, the toner A, which is contained in the developer I and charged to positive polarity by contact with the magnetic carrier and with the toner B, is electrostatically deposited on the image area of the second latent image having the potential V3 of 100 V which is closer to negative polarity than the developing bias voltage Vb of 300 V.

In connection with the developer I, the present inventors have found that from the viewpoint of triboelectric charging characteristics, the components of the developer are classified into two groups, i.e., one comprising the magnetic carrier and the toner B which are negatively charged and the other comprising the toner A which is positively charged and that each component can be triboelectrically charged stably since substantially no triboelectric charging occurs within each group. This is especially of importance in preventing fogging of copy images and in preventing the developer from fuming within the copying machine.

EXPERIMENTAL EXAMPLE 2

An experiment was carried out in the same manner as in Experimental Example 1 with the exception of using the developer (of first kind, referred to as "developer II") described below. The result was satisfactory as in Experimental Example 1. The developer was a magnetic mixture of 65 wt. % of the above-described magnetic carrier, 19 wt. % of the toner B and 16 wt. % of magnetic toner (hereinafter referred to as "toner C") having a mean particle size of 12 μm and a resistivity of $10^{14}$ Ω·cm and prepared from:

| | |
|---|---|
| styrene-acrylic copolymer ("PLIOLITE AC") | 100 parts by weight |
| fine magnetic powder ("MAGNETITE RB-BL") | 20 parts by weight |
| carbon black ("MA#100") | 8 parts by weight |
| charge control dye ("NYGROSINE") | 2 parts by weight |

The toners B and C were both black. The amount of charges on the toner C triboelectrified by the magnetic carrier was +11 μc/g.

The experiment revealed that good results are obtained even when the toner C, which is a magnetic toner, is used as the first toner contained in the developer to be used for the image forming method of the invention.

EXPERIMENTAL EXAMPLE 3

An experiment was conducted in the same manner as in Experimental Example 1 with the exception of applying a developing bias voltage Vb of +400 V which was closer to the potential of the first latent image than the nonimage area potential of +350 V and using the developer (of first kind, referred to as "developer III") described below. The result was satisfactory as in Experimental Example 1. While the toner B was black, the toner D to be described below was red, so that the first latent image was reproduced as a red visible image, and the second latent image as a black visible image, hence in different colors.

The develope,r III was a mixture of 67 wt. % of the above-described magnetic carrier, 20 wt. % of toner B and 13 wt. % of nonmagnetic red toner (referred to as "toner D") having a mean particle size of 11 μm and a resistivity of $10^{15}$ Ω·cm and prepared from:

| | |
|---|---|
| polyester resin (nonlinear saturated polyester) | 100 parts by weight |
| number average molecular weight: | 12,000 |
| weight average molecular weight: | 220,000 |
| glass transition temperature: | 62° C. |
| red pigment ("CHROMOPHTAL RED A38," product of Ciba Geigy) | 5 parts by weight |

The toner D corresponded to the first toner, and the toner B to the second toner. The developer III, unlike the developers I and II, was so adapted that the magnetic carrier and the toner B were triboelectrically charged to positive polarity, and the toner D to negative polarity. Thus the toner D corresponding to the first toner was deposited on the image area of the first latent image. The amount of charges on the toner D charged by the carrier was −12 μc/g.

The experiment showed that when the first toner of the developer to be used for the image forming method of the invention is triboelectrically chargeable to a polarity opposite to the polarity of the first latent image, the toners are deposited on the first and second latent images in a relation reverse to that in the case of Experimental Examples 1 and 2, further indicating that a satisfactory result can be achieved as in the foregoing examples despite the reverse relation.

COMPARATIVE EXPERIMENTAL EXAMPLE 1

An experiment was carried out in the same manner as in Experimental Example 3 with the exception of using a developer IV in the form of a mixture of 74 wt. % of magnetic carrier, 15 wt. % of toner C triboelectrically chargeable to positive polarity by contact with the magnetic carrier, and 11 wt. % of toner D. Thus the toner C was used in place of the toner B in the developer III. Consequently, the first and second latent images were reproduced in the same colors as in Experimental Example 3, but the copy image obtained was poor in quality and fogged, especially with marked red fogging, hence unsuited to use. Moreover, the developer fumed or scattered markedly within the copying machine during operation, thus noticeably staining the interior of the machine.

In connection with these results, the inventors have found the following. The magnetic carrier in the developer IV is triboelectrically charged to negative polarity by contact with the toner C but is charged to positive polarity by contact with the toner D, so that the charges retainable by the magnetic carrier itself are inherently unstable and are only present in a very small amount, consequently failing to hold the toner D electrostatically and permitting the toner D, in particular, to separate from the developer IV easily. This is chiefly responsible for the poor results observed.

The present experiment reveals that when the toner C corresponding to the second toner of the developer useful for the image forming method of the invention is triboelectrically chargeable by contact with the magnetic carrier, satisfactory results as achieved in Experimental Examples 1 to 3 are no longer attainable.

In addition, experiments were conducted in the same manner as Experimental Example 1 except that the magnetic carrier or the toner B was removed from the developer I. In the former case, all the copy images obtained were found to have irregularities and a low image density due to seriously impaired transportability of the developer on the developing sleeve *7a* and to very poor ability of the developer to form a magnetic brush. In the latter case, the first latent image remained totally undeveloped although the second latent image was developed satisfactorily.

EXPERIMENTAL EXAMPLE 4

Using the copying machine of FIG. 1 in the same manner as in Experimental Example 1, a first and a second latent images having an image area potential of 600 V and 100 V respectively relative to an intermediate potential V2 of 350 V were formed. These first and second latent images were then developed with the above described second kind of developer (hereinafter referred to as "developer V") by the developing roller 7 and then transferred to copy paper to obtain a copy image. The bias voltage Vb from the d.c. bias voltage source *7c* was set to 400 V which is slightly higher than V2.

The developer V was a mixture of 70 wt. % of highly magnetic carrier having a mean particle size of 33 μm and a resistivity of $10^8$ Ω·cm and prepared from the following ingredients:

| | |
|---|---|
| iron dioxide (mean particle size of 0.5 μm) | 100 parts by weight |
| zinc oxide (mean particle size of 0.1 μm) | 40 parts by weight |
| nickel oxide (mean particle size of 13 μm) | 17 parts by weight |

by mixing 3000 g of the above ingredients together with 1195 g of water to thereby form a slurry, adding thereto 98 g of water soluble liquid of sodium polymethacrylate for mixing, spray drying by an atomizer, calcining for 2 hours in air to form a composition of ferrite ($(NiO)_{0.3}(ZnO)_{0.7}(Fe_2O_3)_{0.85}$) and screening the resulting particles for classification; 17 wt. % of magnetic toner (first toner, which will be referred to as "toner E") having a mean particle size of 12 μm and a resistivity of $10^{14}$ Ω·cm and prepared from:

| | |
|---|---|
| styrene-acrylic copolymer ("PLIOLITE AC") | 100 parts by weight |
| fine magnetic powder ("MAGNETITE RB-BL") | 20 parts by weight |
| carbon black ("MA#100") | 8 parts by weight |
| charge control dye ("NYGROSINE") | 2 parts by weight |

by mixing the above ingredients together in molten state, pulverizing the mixture after cooling and screeing the resulting particles for classification; and 13 wt. % of magnetic toner (second toner, which will be referred to as "toner F") having a mean particle size of 13 μm and a resistivity of $10^{15}$ Ω·cm and similarly prepared from:

| | |
|---|---|
| styrene-acrylic copolymer ("PLIOLITE AC") | 100 parts by weight |
| carbon black ("MA#100") | 8 parts by weight |

-continued

The toner E and F were both black. The amount of charges on the toners E and F relative to said highly magnetic carrier were +12 μc/g and −1.0 μc/g, respectively. The copy image obtained was satisfactory in image density and quality with respect to fog. The phenomena produced during the development were substantially same as that described in Experimental Example 1.

EXPERIMENTAL EXAMPLE 5

An experiment was carried out in the same manner as in Experimental Example 4 with the exception of using the developer (of second kind, referred to as "developer VI") stated below. The result was satisfactory as in Experimental Example 4. The developer was a mixture of 70 wt. % of the above described highly magnetic carrier described in Experimental Example 4, 20 wt. % of magnetic toner ("toner G") having a mean particle size of 11 μm and a resistivity of $10^{14}$ Ω·cm and prepared from:

| | |
|---|---|
| styrene-acrylic copolymer ("HYMER-SBM 73") | 150 parts by weight |
| fine magnetic powder ("MAGNETITE RB-BL") | 100 parts by weight |
| carbon black ("MA#100") | 6 parts by weight |

and 10 wt. % of toner D described in Experimental Example 3. The toner D corresponded to the first toner and the toner G to the second toner. The developer VI was so adapted that the highly magnetic carrier and the toner G were triboelectrically charged to positive and the toner D to negative polarity. The amount of charges on the toner G was −1.5 μc/g.

COMPARATIVE EXPERIMENTAL EXAMPLE 2

An experiment was carried out in the same manner as in Experimental Example 5 with the exception of using a developer VII in the form of a mixture of 70 wt. % of highly magnetic carrier, 18 wt. % of toner E triboelectrically chargeable to positive polarity by contact with the magnetic carrier, and 12 wt. % of toner D. Thus the toner E was used in place of the toner G in the developer VI. Consequently, the first and second latent images were reproduced in the same colors as in Experimental Example 5, but the copy image obtained was poor in quality and fogged, especially with marked red fogging, hence unsuited to use. Moreover, the developer fumed or scattered markedly within the copying machine during operation, thus noticeably staining the interior of the machine. The reason for this is primarily same as that described in Comparative Experimental Example 1.

EXPERIMENTAL EXAMPLE 6

Using the copying machine shown in FIG. 3 with the photosensitive drum 20 including a photoconductive layer of about 30 μ thick formed by coating $CdS.nCdCO_3$ ($0<n \leqq 4$) photoconductive powder dispersed in heat curable acryl resin and an insulating protective layer of 0.5 μ thick formed over the photoconductive layer by coating acryl resin thereon, the photosensitive drum 20 was first charged to a uniform surface potential of 800 V by the first corona charger 21. Subsequently, a dichromatic original placed on the carriage 22 was successively exposed, then charged to negative by the second corona charger 25 and then again exposed to the same original to form a secondary electrostatic latent image. The potentials for this latent image in FIG. 4*d* were about 300 V for V2, −200 V for V1 and −50 V for V3. For the development, the bias voltage Vb from the voltage source 7*c* was set to −80 V.

This latent image having a first image portion represented by V1 and a second image portion represented by V2 was developed with the developer (developer VII) of the first kind. This developer VII was a mixture of 67 wt. % of magnetic carrier described in Experimental Example 1; 13 wt. % of first toner ("toner H") having a mean particle size of 13 μm and a resistivity of $10^{15}$ Ω·cm and prepared from the ingredients of:

| | |
|---|---|
| styrene-acrylic copolymer ("PLIOLITE AC") | 100 parts by weight |
| red charge control dye | 6 parts by weight |

and 20 wt. % of a second toner of toner B described in Experimental Example 1. The amount of charges on the toner H was 15 μc/g.

The first toner. i.e., the toner H was triboelectrically charged to positive by the magnetic carrier and the second toner of toner B to negative polarity. The dichromatic copy image obtained was satisfactory in image density and quality, being free from fog. Particularly, no mingling of color was observed at all and the dichromatic images of good quality were obtained even during continuous copying.

Numerous modifications and variations of the present invention are possible in light of the above teachings and, therefore, within the scope of the appended claims, the invention may be practiced otherwise than particularly described.

What is claimed is:

1. An image forming method comprising a step of forming an electrostatic latent image having at least three levels of potential with a first potential representing a first image area, a second potential representing a second image area and a background potential for the first and second images; and a step of developing said electrostatic latent image with a magnetic developer of a mixture of at least three components which includes a magnetic carrier, a first toner triboelectrically chargeable to a specific polarity by contact with the magnetic carrier, and a second toner triboelectrically chargeable by contact with the first toner to a polarity opposite to the polarity of first toner but substantially not triboelectrically chargeble by contact with the magnetic carrier and at least said second toner being a magnetic toner.

2. An image forming method comprising a first step of forming on a photosensitive member a first electrostatic latent image and a second electrostatic latent image opposite in polarity or the same in polarity but different in potential relative to the first electrostatic latent image; a second step of developing said first and second electrostatic latent images with a magnetic developer of a mixture of at least three components which include a magnetic carrier, a first toner triboelectrically chargeable to a specific polarity by contact with the magnetic carrier, and a second toner triboelectrically chargeable by contact with the first toner to a polarity opposite to the polarity of first toner but substantially not triboelectrically chargeable by contact with the magnetic carrier, at least said second toner being a magnetic toner, whereby said first and second toners are selectively deposited on said first and second electrostatic latent images; and a third step of transferring said developed image onto a copying paper.

3. An image forming method as claimed in claim 2 wherein said magnetic carrier has a resistivity of at least $10^{12}$ Ω·cm and a mean particle size of about 25 to 50 μm, said first toner having a resistivity of at least $10^{14}$ Ω·cm and a mean particle size of about 5 to 20 μm, and said second toner having a resistivity of at least $10^{12}$ Ω·cm and a mean particle size of about 5 to 20 μm.

4. An image forming method as claimed in claim 3 wherein said first and second toners are different in color.

5. An image forming method as claimed in claim 3 wherein at least one of said first and second toners is magnetic.

6. An image forming method as claimed in claim 2 wherein said magnetic carrier has a resistivity of at least $10^{7}$ Ω·cm and a mean particle size of about 25 to 90 μm, and said first and second toners respectively having a resistivity of at least $10^{12}$ Ω·cm and a mean particle size of about 5 to 20 μm and at least one of said toners is magnetic.

* * * * *